US007373812B2

(12) United States Patent
Ma et al.

(10) Patent No.: US 7,373,812 B2
(45) Date of Patent: May 20, 2008

(54) APPARATUS FOR SAMPLING AND LOGGING ON ALL PRODUCING ZONES OF A WELL

(76) Inventors: Yong Ma, No.21-213, Dormitory Xian Petroleum Institute, No. 18, Dianzier Road, Xian City, Shanxi Peovince, 710065 (CN); Jianguo Ma, No.14-301, Dormitory Xian Petroleum Institute, No. 18, Dianzier Road, Xian City, Shanxi Peovince, 710065 (CN)

( * ) Notice: Subject to any disclaimer, the term of this patent is extended or adjusted under 35 U.S.C. 154(b) by 119 days.

(21) Appl. No.: 10/479,769

(22) PCT Filed: May 31, 2002

(86) PCT No.: PCT/CN02/00378

§ 371 (c)(1),
(2), (4) Date: Jun. 11, 2004

(87) PCT Pub. No.: WO02/003159

PCT Pub. Date: Dec. 27, 2002

(65) Prior Publication Data

US 2004/0221983 A1 Nov. 11, 2004

(30) Foreign Application Priority Data

Jun. 7, 2001 (CN) ..... 01 1 15287

(51) Int. Cl.
*E21B 49/00* (2006.01)

(52) U.S. Cl. ..... 73/152.23

(58) Field of Classification Search ..... None
See application file for complete search history.

(56) References Cited

U.S. PATENT DOCUMENTS

| | | | | |
|---|---|---|---|---|
| 4,224,988 | A | 9/1980 | Gibson et al. | |
| 4,573,532 | A * | 3/1986 | Blake | 166/264 |
| 4,690,216 | A | 9/1987 | Pritchard, Jr. | |
| 4,860,581 | A | 8/1989 | Zimmerman et al. | |
| 4,879,900 | A | 11/1989 | Gilbert | |
| 4,893,505 | A | 1/1990 | Marsden et al. | |

(Continued)

FOREIGN PATENT DOCUMENTS

GB 2355033 11/2001

OTHER PUBLICATIONS

Badry et al., "New Wireline Formatin Tester Techniques and Applications", SPWLA 34th Annual Logging Symposioum, Jun. 13-16.*

*Primary Examiner*—Robert Raevis
(74) *Attorney, Agent, or Firm*—Greenberg Traurig, LLP

(57) ABSTRACT

The present invention discloses a full reservoir sampling and testing apparatus having a ground surface testing and controlling tool (36) and a downhole tool (1), the downhole tool (1) comprises a wireline bridle (21), an adapter joint AH64 (2) connected to the wireline bridle (21), a GR pup joint, an electric unit (4), a single probe unit (5), a pumping unit (6), a dual packer unit (7), and a multi sampling unit (8); the ground surface testing and controlling tool (36) comprises a power supply controller, a computer system and a relevant control, analysis and interpretation software; an upper portion of the pumping unit (6) is connected to the single probe unit (5) and a lower portion thereof is connected to the multi sampling unit (8).

9 Claims, 5 Drawing Sheets

U.S. PATENT DOCUMENTS

| | | | | |
|---|---|---|---|---|
| 4,936,139 | A | 6/1990 | Zimmerman et al. | |
| 4,994,671 | A | 2/1991 | Safinya et al. | |
| 5,303,775 | A | 4/1994 | Michaels et al. | |
| 5,377,755 | A | 1/1995 | Michaels et al. | |
| 5,934,374 | A | 8/1999 | Hrametz et al. | |
| 6,761,062 | B2 * | 7/2004 | Shapiro | 73/152.41 |
| 2002/0129936 | A1 * | 9/2002 | Cernosek | 166/264 |
| 2005/0028974 | A1 * | 2/2005 | Moody | 166/264 |
| 2005/0155760 | A1 * | 7/2005 | Hill et al. | 166/264 |

* cited by examiner

APPARATUS FOR SAMPLING AND LOGGING ON ALL PRODUCING ZONES OF A WELL

FIELD OF THE INVENTION

The present invention relates to a full reservoir sampling and testing apparatus which is a large oil logging device and also a novel wireline formation tester having a function of collecting original fluid samples of respective reservoirs in large batches.

BACKGROUND ART OF THE INVENTION

A wireline formation tester is the only one logging device which can test formation dynamic properties of hydrocarbon reservoirs. The first formation tester was developed by Schlumberger Technology Corporation in 1955, which was used widely through 1960s to 1970s, but it could only test one formation pressure by going to the downhole one time, taking one formation fluid sample and employing an electric ignition valve. In 1974, Schlumberger Technology Corporation developed a Repeated Formation Tester RFT. Western Atlas International, Inc developed a Formation Multi Tester FMT in 1980, thereafter, Western Atlas International, Inc developed a selective formation tester SFT. These testers are all used as logging device in prospecting well until now and are reservation products of wireline formation tester. Such testers can test formation pressure and formation effective permeability of an arbitrary formation point by going to the downhole one time and test two formation fluid samples at most, in addition, all operations thereof are hydraulic controlled automatically. In 1998 and 1990, Schlumberger Technology Corporation obtained the U.S. Pat. No. 4,860,581 entitled "downhole tool for determination of formation properties", and U.S. Pat. No. 4,936,139 entitled "downhole method for determination of formation properties" (corresponding Chinese Patent number 89107138.5), the above patents were put into use in 1990, hence, the wireline formation tester has a function of pump discharging mud filtrate into a well bore, so that the tester can test a formation original fluid sample. Such tester has the following features that it employs the following technology: combining the optical frequency identification and electrical resistivity identification between the mud filtrate and the formation original fluid sample, a technology of determining the formation horizontal and vertical permeability by a plurality of probes, a combination technology of multi-level sampling, and a technology of combining different tools freely for performing many functions. In 1994 and 1995, Western Atlas International, Inc obtained the U.S. Pat. Nos. 5,303,775 and 5,377,755 entitled "method and apparatus for acquiring and processing subsurface samples of original fluid" (i.e. reservoir property tester—RCI), in which a pumping piston is proposed, the pumping piston has dual functions and unequal diameters and pumps directly a formation fluid, whose pressure is higher than the bubble point pressure, into a sampling chamber continuously, the apparatus can take six formation original fluid samples by going to the downhole one time and further be provided with a standby probe. In 1999, Halliburton Energy Services, Inc obtained the U.S. Pat. No. 5,934,374 entitled "formation tester with improved sample collection system", the formation tester has the following features: the pump discharging capacity of general 2.2L/min (0.6 gpm) is increased to 3.6L/min (1 gpm); and the dual probes which are spaced by 184.15 mm are used, so that the pump discharging capacity of the mud filtrate is increased and an anisotropic formation permeability can be measured; sampling without impact is the standard form of sampling; a pre-test process of the dual-probe and pumping output is performed by using a digital feedback control system so as to optimize the flow velocity.

SUMMARY OF THE INVENTION

In order to widen usable range of the wireline formation tester and make it more practical, there is provided a novel apparatus called full reservoir sampling tester, which can measure a mud column pressure and a formation pressure at an arbitrary depth in an open hole well, the full reservoir sampling and testing apparatus can also measure and record gradient sections of the mud column pressure and formation pressure by going to the downhole one time. A more important purpose of the full reservoir sampling and testing apparatus of the present invention is to obtain high quality of formation original fluid sample in large batches. At the downhole test point, the mud filtrate in formation fluid may be pumped into a well bore by a pump and the sample is identified in time. After the fluid sample is determined as the original formation fluid sample, sampling is performed through pumping, thus obtaining samples of high Pressure Volume Temperature (PVT), such samples can be collected more than ten times by going to the downhole one time.

The full reservoir sampling and testing apparatus comprises a ground surface testing and controlling tool, wirelines, and a downhole tool.

The downhole tool of the full reservoir sampling and testing apparatus comprises a wireline bridle, an adapter joint AH64, a gamma ray detector, an electric unit, a single probe unit, a pumping unit, a dual packer unit, and a multi sampling unit, in which the gamma ray detector, the electric unit and the single probe unit are all corollary equipment.

The ground surface testing and controlling tool comprises a power supply controller, a computer system and a relevant control, analysis and interpretation software, the electric unit is composed of a downhole power supply and control interfaces, monitor interfaces and communication interfaces of each unit, they form a digital transmission electric system together. The digital transmission electric system and the data interpretation system of the full reservoir sampling and testing apparatus shall be filed for other patents by the present applicant, so that detailed descriptions thereof are omitted here.

The pumping unit is a complex hydraulic system, an upper portion of the pumping unit is connected to the single probe unit and a lower portion thereof is connected to the multi sampling unit, the pumping unit has a pump discharging function of discharging a formation mud filtrate into a mud of high back pressure in a well bore, a pumping pre-test function of performing various-volume pre-tests, a pump piston of the pumping unit is provided with a suction chamber having a pre-test function, volume of the suction chamber can be changed from zero to a predetermined value repeatedly under action of hydraulic pressure, thus performing pre-test many times, the maximum volume of the suction chamber is 500 ml, thus providing various pre-testing flow having a large variation range, and a pumping and sampling function of closing a discharging passage of the mud filtrate through a program control and pumping formation fluid into one sampling chamber when a sample is identified as a formation original fluid sample during the discharging.

An oil tank of the hydraulic system of the pumping unit is full filled with high temperature hydraulic oil, a balance piston and a spring are provided in the oil tank, the piston partitions the oil tank and the mud, when the tool is disposed in the well, the pressure of mud increases with the depth increase, so as to remove the balance piston, thus keeping the pressure in the oil tank 42 equal to the environment mud pressure all the time. When the pressure in the oil tank 10 is higher than a predetermined value, a fixed value pressure release valve performs pressure relief.

The pumping unit uses a power system having a DC brushless motor and a variable flow pump, or multi power systems having several AC motors and several constant flow pumps, the multi-power-systems employ a plurality of motors to drive a plurality of plunger pumps respectively. After the motor starts up, the constant flow pump is rotated, and the hydraulic oil is pumped into a high pressure pipeline. A pump sensor records the relative pressure in the high pressure pipeline with respect to a static fluid column pressure of the mud at a testing point, when the pressure exceeds the maximum working pressure of the high pressure pipeline, a fixed value pressure release valve releases the oil to the oil tank.

A piston of the hydraulic chamber divides the hydraulic chamber into four chambers, the high pressure hydraulic oil in the high pressure pipeline enters alternatively into the outside chambers of the hydraulic chamber, and the low pressure hydraulic oil of the hydraulic chamber is alternatively discharged into the oil tank. The oil discharging pump has different discharging amount with relatively large changeable range. The reciprocating movement of the hydraulic chamber piston is controlled by a solenoid valve and four two position-two way oil controlled reversing valves. The reciprocating movement of the hydraulic chamber piston is reversed through four check valves, thus sucking continuously the formation fluid samples from the dual packer unit and pumping the samples into the well bore or a sampling chamber after pressurizing.

A pressure sensor is provided in the sample pipeline and used for recording a pressure value variation of the fluid in the pipeline with respect to the ground surface atmospheric pressure.

An upper end of the dual packer unit is connected to the pumping unit and a lower end thereof is connected to the multi sampling unit. The function of the dual packer unit is to seal and isolate the formation to be tested from the top and from the bottom, so that the formation to be tested is only communicated with a sample inlet pipeline of the full reservoir sampling and testing apparatus, thus testing or pumping the samples of the sealed and isolated formation. A dual packer has two sealing and isolating capsules, when the well fluid is transported from the pumping unit to the sealing and isolating capsules through the high pressure pipeline, bodies of the sealing and isolating capsules inflate so as to cling well walls, thus forming a sealing and isolating section of the formation. There is provided an opening on the casing of the packer between the two sealing and isolating capsules, the opening is used for communicating with the well fluid, and is a start point from which the well fluid and the formation fluid enters the sample inlet pipeline, in order to prevent large particles of the foreign material contained in the well fluid from entering into the sample inlet pipeline, a filter is provided at an entrance of the sample inlet pipeline.

The dual packer control section is a control assembly used for controlling "seating and sealing" and unsealing of sealing and isolating capsules thereof, a hydraulic oil tank is provided at the dual packer control section, and a balance piston is provided in the hydraulic oil tank to partition the hydraulic oil tank into two portions, an outside of the piston is communicated with the well fluid mud, and an inside thereof is filled with a hydraulic oil, the balance piston can move in the hydraulic oil tank, thus keeping an oil pressure in the hydraulic oil tank equal to a well fluid pressure all the time; the dual packer control section is also provided with an isolation valve, a seal valve, a check valve, a solenoid valve, a pump pressure sensor, a pressure release valve and so on , to accomplish "seating and sealing" and unsealing of the dual packer, a sample identifying sensor is connected in a sample, pipeline of the dual packer control section in series for identifying physical properties of a fluid sample passing through the sample pipeline. The multi sampling unit comprises a plurality of sampling chambers, one artesian flow sampling chamber, and a series of control valves and sample transport valves. Each sampling chamber has a volume of 450 ml and can be detached freely. A piston is provided in each sampling chamber to partition the sampling chamber into an upper chamber for collecting sample and a lower chamber having an opening to communicate with the well fluid mud, thus ensuring a pressure in the sampling chamber being much higher than the formation static pressure while and after sampling is performed. In the pipeline from the packer control section to the multi sampling unit, two igniter switch valves are connected to each sampling chamber in series, one of which is normally closed and the other is normally opened; closing and opening of each sampling chamber are controlled by the igniter switch valves, each igniter switch valve is composed of an electric igniter and a slide valve switch. When a first igniter switch valve is powered, the sample pipeline is communicated with a selected sampling chamber into which the high pressure fluid sample can be pumped. After the sampling chamber is filled, a second igniter switch valves is powered, the generated high pressure gas causes the switch valve to be locked one-off, therefore, the fluid sample in the sampling chamber can be kept in a state in which the fluid sample pressure is higher than the formation pressure, the sampling chamber, in which the sample will be filled, can be selected freely for each sampling. The artesian flow sampling chamber can accommodate a sample of 10-20L and a seal valve is connected in the pipeline in front of the artesian flow sampling chamber. One function thereof is that the formation fluid sample flows automatically into the sampling chamber during an initial stage of sampling without starting up the pumping, the above samples are mainly the mud filtrate which can not represent the formation original sample, the mud filtrate can be accelerated to be discharged by this method. The other function thereof is that: even if the permeability of the formation is low, the sample of the formation point can be collected.

The full reservoir sampling and testing apparatus of the present invention can freely cling the single probe or the dual packer to all hydrocarbon reservoirs and formation points which may contain oil gas, so as to measure directly their original formation pressures, formation temperatures, formation permeability and formation pollution coefficients and to measure directly dynamic parameters such as formation fluid productivity index (or IPR curve, i.e. inflow performance relationship curve) by using various flows. With more than ten sampling chambers, it can directly obtain formation original fluid samples in large batches, so that it can meet requirements of sampling in full reservoir substantially and increase the value of the sampled and tested data in the hydrocarbon exploration and exploitation, in addition, all fluid physical parameters of the formation fluid can be obtained by analyzing the original fluid samples under conditions of high temperature-high pressure and atmospheric pressure. The results of each formation fluid sample analyzed under conditions of atmospheric temperature and atmospheric pressure comprise: crude oil density, viscosity, solidifying point, contained water, contained sand, contained salt, contained wax, contained sulfur, water type, ion content, gas composition and so on. The results of each formation fluid sample analyzed under conditions of high temperature and high pressure comprise: saturation pressure, original oil gas ratio, densities of oil, gas and water, viscosities of oil, gas and water, average solubility factor, volume factor of oil, gas and water, compressibility of oil, gas and water, shrinkage ratio, gas density, compressibility factor and so on. Based on the above two types of data, it can further explain outputs of oil, gas and water of each formation, quantitatively predict outputs of oil, gas and water at well top and determine two phase interfaces between gas and oil, between oil and water and between gas and water respectively.

By using the above data, it can create a full parameter database of the full reservoir original formation dynamics of a well similar to a core chamber and a full parameter database of full reservoir original fluid property, the above databases can be used to direct the exploration and exploitation of the oil-gas field, thus improving the work quality and increasing the economic effectiveness.

The full reservoir sampling and testing apparatus of the present invention optimizes the hydraulic circuit design, achieving controlling the cling and pre-test separately, having a multi-flow pre-test function, and increasing the accuracy of the pre-test; the suction chamber of the pump is additionally used as a pre-test chamber and there is provided a full volume and a series of selective volume, this is advantageous to optimize the pre-test volume based on the difference in formation. A selecting range of discharge capacity of the program control adjusted pump can be enlarged by using the multi power system so as to exert potentiality of a low powered pump. Since the saturation pressure of formation can be measured simply, optimization of the pump discharge capacity becomes simple. The pre-tests of the loose sand, the viscous crude reservoir and the oil reservoir having specially low permeability can be performed successfully by providing the dual packer. The lower chamber is communicated with well fluid mud, so that the sample pressure is greatly higher than the formation static pressure, thus ensuring the sample pressure being not lower than saturation pressure under any circumstances. By providing, more than ten sampling chamber for the original fluid sample, it can meet the requirements of sampling frequency of a general exploratory well. It is reliable and low cost to control the opening and closing of the sampling chamber by the ignition switch valves.

BRIEF DESCRIPTION OF THE DRAWINGS OF THE INVENTION

DETAILED DESCRIPTION OF THE PREFERRED EMBODIMENT OF THE PRESENT INVENTION

In order to achieve the function and object of the full reservoir sampling and testing apparatus, a preferred structure of the present invention is described as follows.

Figure 1:
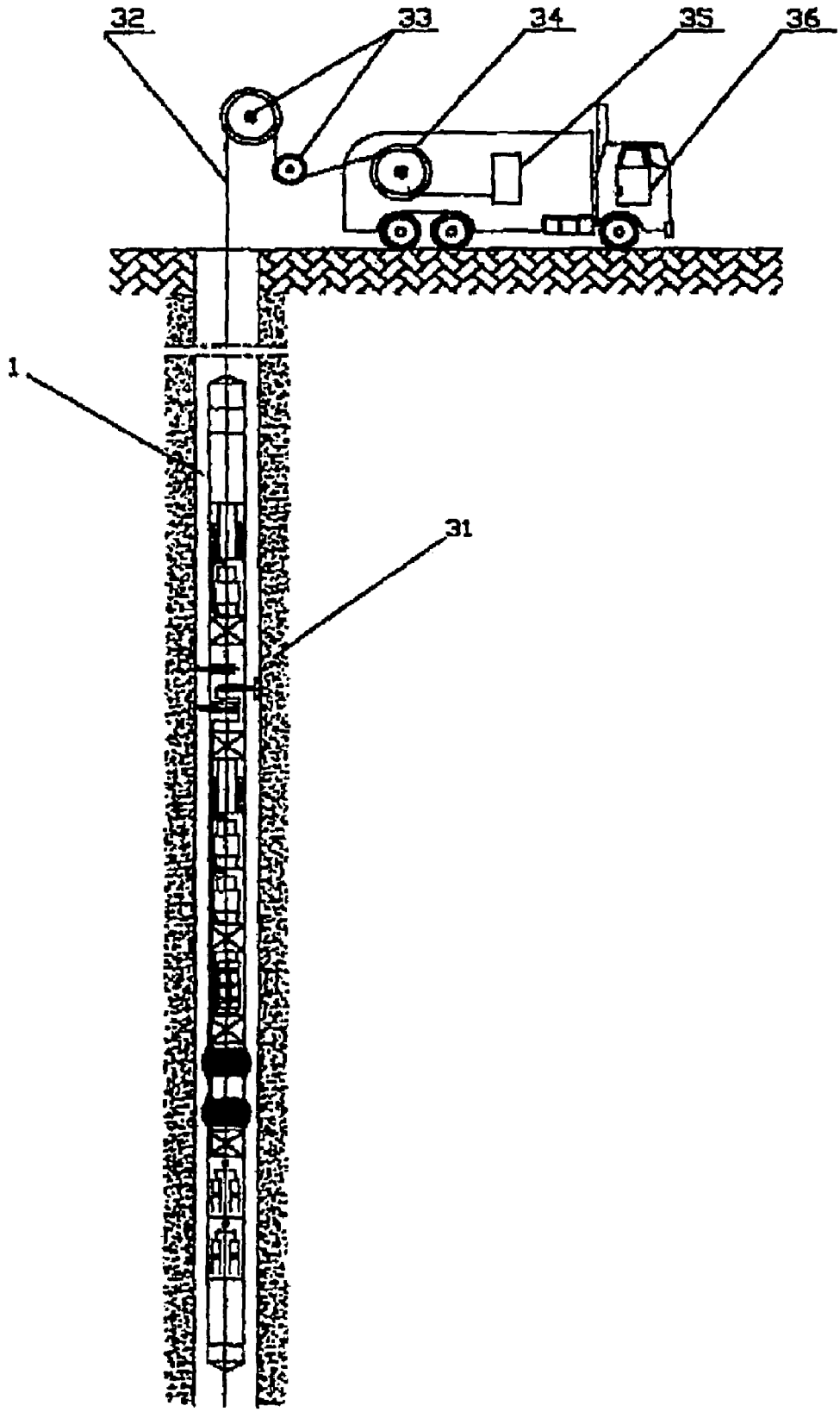
FIG. 1 is a structural view of the full reservoir sampling and testing apparatus according to the present invention.

As shown in FIG. 1, the full reservoir sampling end testing apparatus 1 performs well logging operations as follows: a wireline 32 of a ground surface logging vehicle 36 passes a pulley 33 and goes to the downhole, the wireline 32 is lifted or lowered by a roller 34, so that a single probe or dual packer is positioned at a predetermined formation 31 of a logged section, then under control of a ground surface control system 35, the wireline 32 is pushed against or seated and sealed in the formation 31, thus performing the logging operations.

Figure 2:
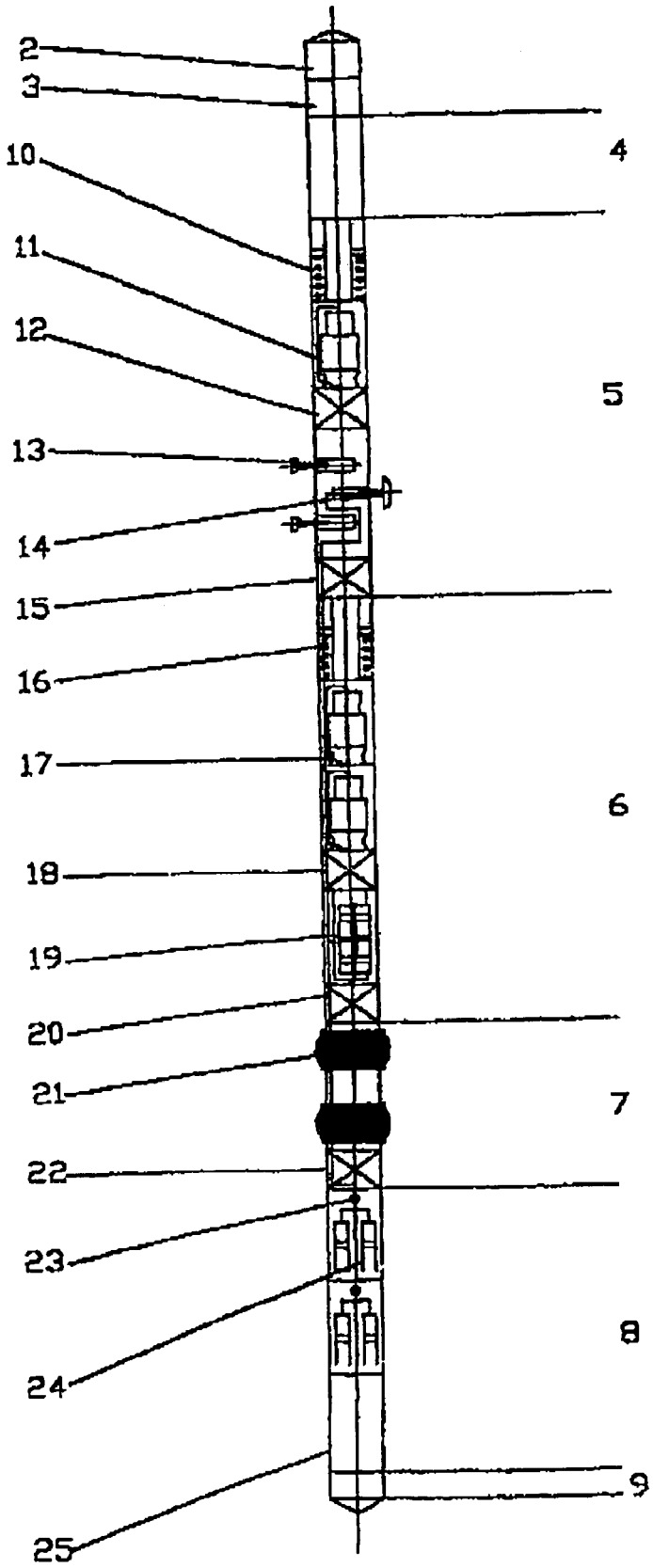
FIG. 2 is a structural view of the downhole tool of the full reservoir sampling and testing apparatus according to the present invention.

FIG. 2 is a structural view of the downhole tool of the full reservoir sampling and testing apparatus according to the present invention. As shown in FIG. 2, a combined downhole tool series of the full reservoir sampling and testing apparatus is composed of an electric unit 4, a single probe unit 5, a pumping unit 6, a dual packer unit 7, a multi sampling unit 8 and a base cone 9.

In addition, the downhole tool can be combined as the following three series: (1) an electric unit 4, a single probe unit 5, an artesian flow sample barrel 25 and a base cone 9; (2) an electric unit 4, a single probe unit 5, a pumping unit 6, a multi sampling unit 8 and a base cone 9; (3) an electric unit 4, a pumping unit 6, a dual packer unit 7, a multi sampling unit 8 and a base cone 9.

The above four combined tool series are all necessary to be coupled with a gamma ray detector 3, an adapter joint AH64 2 and a wireline bridle.

The electric unit 4 is composed of a downhole power supply and a control circuit device of each unit.

The single probe unit 5 is composed of a hydraulic oil tank 10, a power section 11, an upper fluid control section 12, a supporting piston 13, a single probe 14 and a lower fluid control section 15.

The pumping unit 6 is composed of a hydraulic oil tank 16, a multistage power section 17, an upper pumping fluid control section 18, a pumping fluid tank 19 and a lower pumping fluid control section 20, the pumping is performed at the selected maximum discharging capacity under a pressure higher than the formation fluid saturation pressure.

The dual packer unit 7 is composed of a dual packer 21 made of rubber and a dual packer control section 22.

The multi sampling unit 8 is composed of an igniter switch valve 23, a sampling chamber 24 and an artesian flow sampling chamber 25.

The gamma ray detector 3, the single probe unit 5, the adapter joint AH64 2 and the logging vehicle 36 are all corollary equipment.

The pumping unit 6 is a complex hydraulic system, connected to the single is probe unit 5 at an upper portion thereof and connected to the dual packer unit 7 at a lower portion thereof. The function of the pumping unit 6 is that: 1) pump discharging the filtrate, and discharging the formation mud filtrate into the high back pressure mud in the well bore; 2) pumping pre-test, in which it can perform selective volume pre-test, full volume pre-test, selective flow pre-test, and limit pressure pre-test; 3) pumping and sampling, when the sample is identified as the formation original fluid sample, the mud filtrate discharging passage is shut off through programmed control, the formation fluid is communicated to the multi sampling unit, thus the formation original fluid being kept in one sample barrel by a pressure higher than the static fluid column pressure of the mud.

Figure 3:
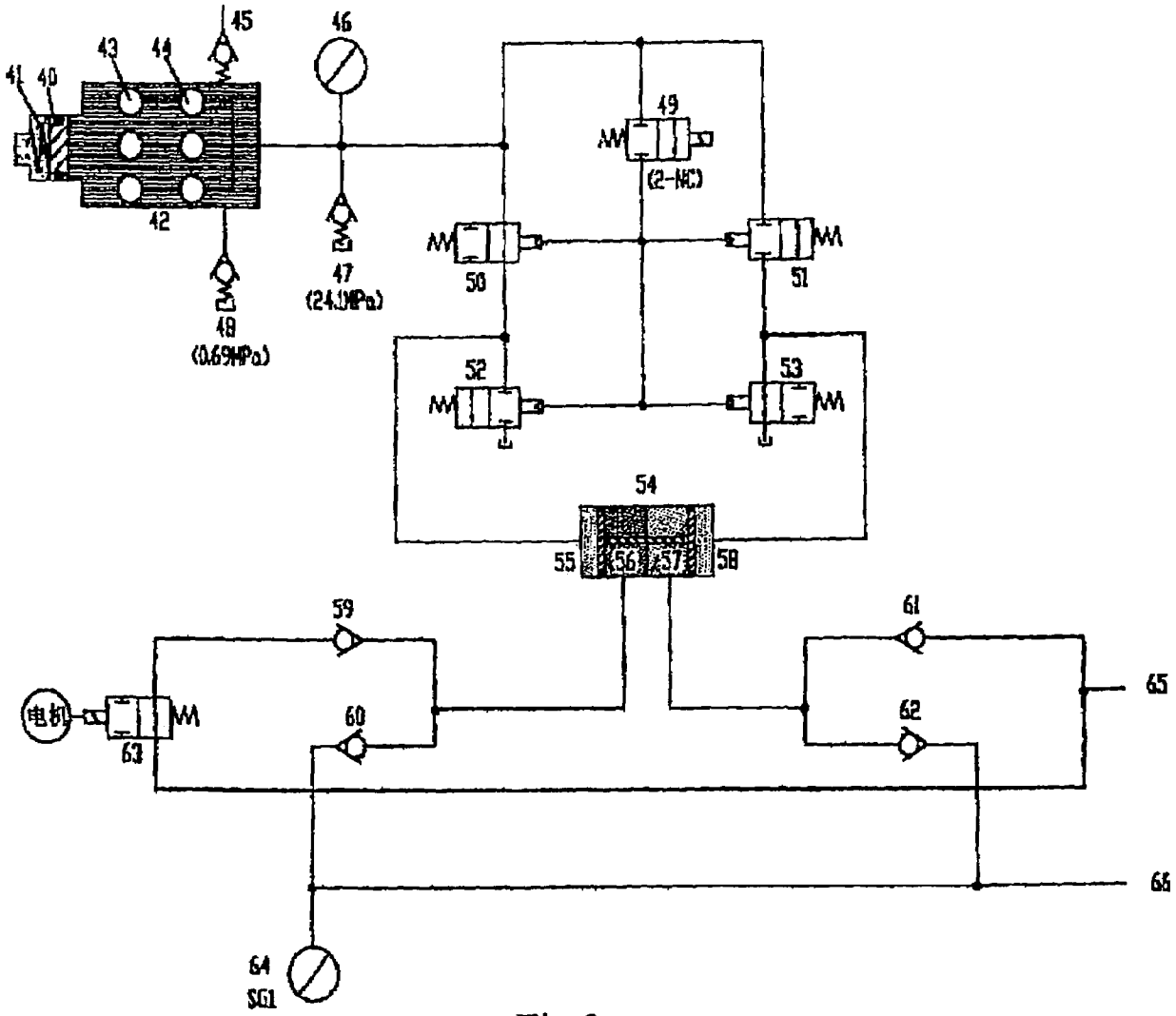
FIG. 3 is a principle diagram of the hydraulic system of the pumping unit of the present invention.

FIG. 3 is a principle diagram of the hydraulic system of the pumping unit 6. An oil tank 42 of the hydraulic system of the pumping unit 6 is a volume-variable sealed tank, in which high temperature resistant hydraulic oil is filled, a balance piston 40 and a spring 41 are provided in the oil tank 42, the piston 40 partitions the oil tank 42 and the mud, when the tool is disposed in the well, the pressure of mud increases with the depth increase so as to move the balance piston 40, thus keeping the pressure in the oil tank 10 equal to an environment mud pressure all the time. An oil-filling valve 45 of the oil tank is used for filling oil in the oil tank 10. When the pressure in the oil tank 10 is higher than 0.69 Mpa, a fixed value full pressure release valve 48 performs pressure relief.

The power system of the pumping unit can be designed as two types: 1) DC brushless motor+variable flow pump; 2) several AC, DC motors 43+several constant flow pump 44 (multi power system).

After the motor 43 starts up, the constant flow pump 44 is rotated and the hydraulic oil is pumped into the high pressure pipeline. A pump sensor 46 records the relative pressure in the high pressure pipeline with respect to the mud static fluid column pressure at the testing point, the highest working pressure of the high pressure pipeline is 24.1 Mpa, when the pressure exceeds 24.1 Mpa, a fixed value pressure release valve 47 pressure releases the oil to the oil tank.

A pumping hydraulic chamber 54 is an essential element of the pumping unit, the piston of the hydraulic chamber 54 divides the hydraulic chamber into four chambers 55, 56, 57, 58, the high pressure hydraulic oil in the high pressure pipeline enters alternatively into the chamber 55 and 58 of the hydraulic chamber 54, and the low pressure hydraulic oil of the hydraulic chamber 54 alternatively enters into the chambers 58 and 55, and then is discharged into the oil tank. The reciprocating movement of the piston of the hydraulic chamber 54 is controlled by a solenoid valve 49 and four two position-two way oil controlled reversing valves 50, 51, 52, 53.

When the solenoid valve 49 is turned off, the high pressure hydraulic oil enters the left chamber 55 of the hydraulic chamber 54 via the reversing valve 50, the right chamber 58 of the hydraulic chamber 54 is communicated with the oil tank through the reversing valve 53, the pumping piston moves rightward, when the pumping piston reaches its predetermined position, the solenoid valve 49 is powered accordingly, the high pressure hydraulic oil flows into the four reversing valves 50, 51, 52, 53 through the solenoid valve 49, so that the reversing valves are reversed by hydraulic control. The corresponding high pressure hydraulic oil is filled in the right chamber 58 of the hydraulic chamber 54, the left chamber 55 is communicated with the oil tank, so that the piston moves leftward. In a similar way, the pumping piston can reciprocate continuously. The reciprocating movement of the pumping piston causes the formation fluid sample in the dual packer to be sucked and pumped into the well bore. When the pumping piston moves rightward, the formation fluid sample in the dual packer is sucked through the pipeline 66 and into chamber 57 via a check valve 62, at the same time, the formation fluid sample in the chamber 56 is pressurized and filled into sample high pressure pipeline 65 through a check valve 59, then pumped into the well bore or the sampling chamber, when the pumping piston moves leftward, the chamber 56 is the suction chamber, the formation fluid sample enters into the chamber 56 through the pipeline 66 and a check valve 61; the chamber 57 is the pressurizing chamber, the formation fluid sample is pressurized, then enters into the sample high pressure pipeline 65 through a check valve 61. In a similar way, the pumping piston reciprocates and is reversed through the four check valves 59, 60, 61, 62, thus it pumping the pressurized formation fluid sample into the well bore or the sampling chamber continuously.

A strain pressure meter 64 is provided in the sample pipeline and used for recording the pressure value of the fluid in the pipeline with respect to the ground surface atmospheric pressure. In order to accomplish the pumping pre-test, a seal valve 63 is provided in the sample pipeline, during the pumping pre-test, the seat valve 63 is shut off, so that the pump discharging is stopped.

Figure 4:
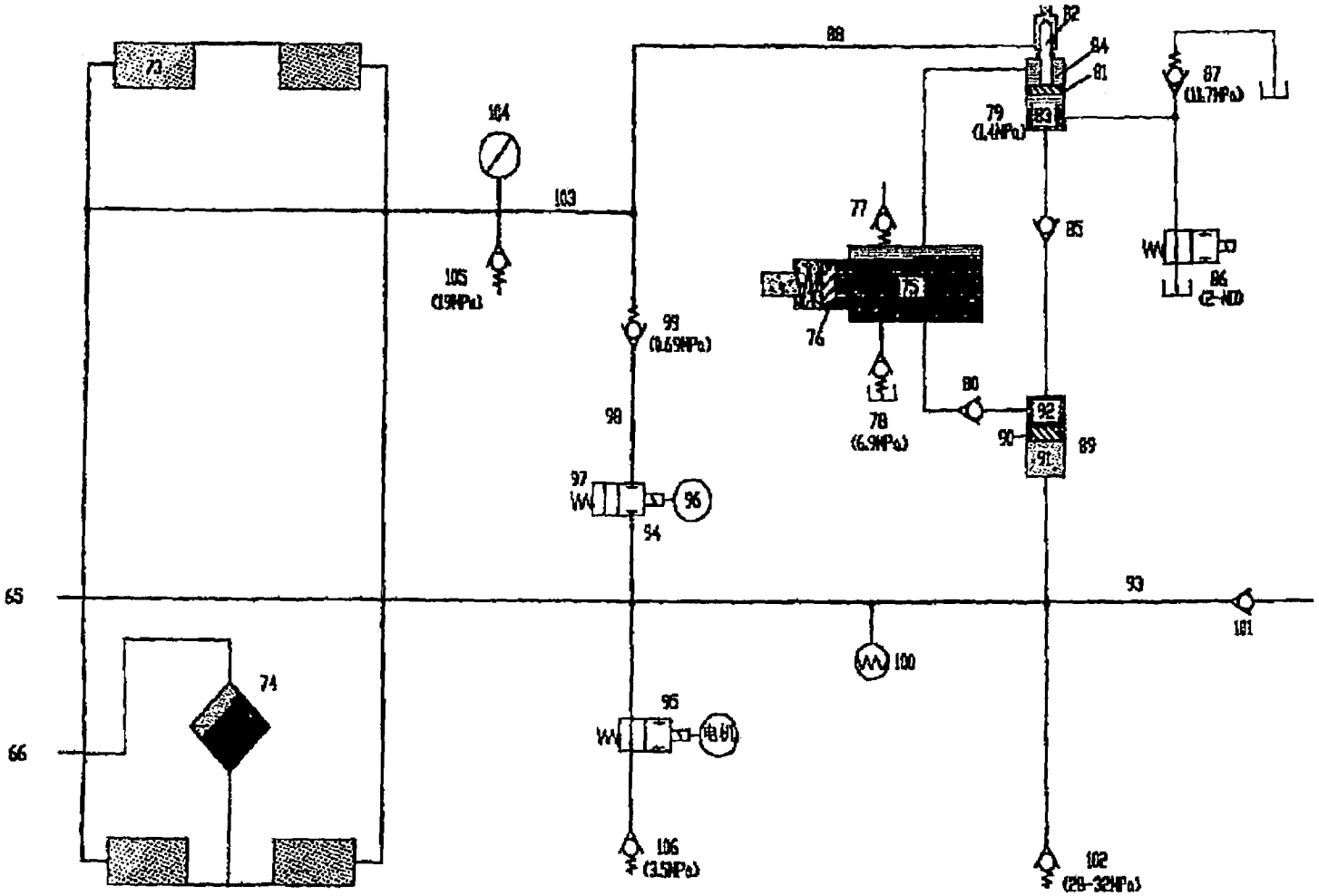
FIG. 4 is a principle diagram of the hydraulic system of the dual packer unit of the present invention.

FIG. 4 is a principle diagram of the hydraulic system of the downhole dual packer unit 7 of the present invention. An upper end of the dual packer unit 7 is connected to the pumping unit 6 and a lower end thereof is connected to the multi sampling unit 8. The function of the dual packer unit 7 is that the sealing and isolating capsules thereof seal and isolate the formation to be tested up and down, so that the formation to be tested is only communicated with the sample inlet pipeline 66 of the full reservoir sampling and testing apparatus, thus testing or pumping the sample of the sealed and isolated formation.

A dual packer 21 has two sealing and isolating capsules 73, when the well fluid is transported from the pumping unit 6 to the sealing and isolating capsules 73 through the high pressure pipeline 65, bodies of the sealing and isolating capsules 73 inflate so as to cling the well walls, thus forming the sealing and isolating section of the formation. There is provided an opening on the casing of the packer 21 between the two sealing and isolating capsules 73, the opening is used for communicating with the well fluid, and which is also the start point from which the well fluid and the formation fluid enter into the sample inlet pipeline 66, in order to prevent the large particles of the foreign material contained in the well fluid from entering into the sample inlet pipeline, a filter 75 is provided at the entrance of the sample inlet pipeline 66.

The dual packer control section 22 is the control assembly used for controlling the "seating and sealing" and unsealing of the sealing and isolating capsules 73 of the dual packer 21. A hydraulic oil tank 75 is provided at the dual packer control section 22, and a balance piston 76 is provided in the hydraulic oil tank 75, the balance piston 76 divides the hydraulic oil tank 75 into two portions, an outside of the piston 76 is communicated with the well fluid mud. And an inside of the piston 76 is filled with the hydraulic oil, the balance piston 76 can move in the hydraulic oil tank 75, thus keeping the oil pressure in the hydraulic oil tank 75 equal to the well fluid pressure all the time. The hydraulic oil tank 75 is communicated with the oil filling valve 77, the pressure release valve 78, an isolation valve 79 and a check valve 80. The hydraulic oil can be filled into inside of the tool through the oil filling valve 77. When the pressure of the oil inside the tool exceeds 6.9 Mpa, the hydraulic oil can be discharged through the pressure release valve 78.

The isolation valve 79 is composed of a piston 81 and a piston rod 82, the piston 81 divides the chamber of the isolation valve 79 into two oil chambers 83 and 84, the oil chamber 83 is communicated with a check valve 85, a solenoid valve 86 and a pressure release valve 87. When the hydraulic oil flows into the oil chamber 83 through the check valve 85, the piston 81 is pushed to move, the return oil from the oil chamber 84 flows to the oil tank 75. Since the piston 81 moves the piston rod 82, the communication between a sample pipeline 88 and the well fluid is shut off. Therefore, it is prepared for the "seating and sealing" of the packer. On the contrary, if the pressure in the oil chamber 83 is higher than that in the oil chamber 84, the piston 81 and the piston rod 82 are retracted, so that the pipeline 88 is communicated with the well fluid, since the pressure of the piston chamber of the packer is released, the sealing and isolating capsules are "unsealed".

The pressure release valve 87 is used for releasing the oil into the oil tank when the oil pressure in the oil chamber 83 of the isolation valve 79 exceeds 11.7 Mpa. The solenoid valve 86 is a two-position and two-way normally powered solenoid valve, when the solenoid valve 86 is not powered, the oil pressure pipeline is communicated with the oil tank, thus keeping the packer in a unsealing state, when the solenoid valve 86 is powered, the oil pressure pipeline is isolated from the oil tank, so that the oil pressure in the oil chamber 83 of the isolation valve is kept high, thus keeping the packer in a "seating and sealing" state.

A piston 90 of a balance piston 89 divides the valve chamber into two chambers 91 and 92, the chamber 91 is connected with a sample pipeline 93, and the chamber 92 is connected with the hydraulic pipeline. The piston 90 partitions the hydraulic medium, but can transmit hydraulic pressure.

Two seal valves 94 and 95 are connected to the sample pipeline in the dual packer control section 22 in series, each of which is composed of a DC motor 96 and a driving slide valve 97. A fluid inlet of the seal valve is communicated with the sample high pressure pipeline 65 which is from the pumping unit, but an outlet of the seal valve 94 is communicated with a pipeline 98. An outlet of the seal valve 95 is communicated with a fixed value pressure release valve 106. When the motors 96 of the seal valves 94 and 95 are powered, the pumped fluid flow can be transported to the pipeline 98. A fixed value pressure release valve 99 is connected to the pipeline 98 in series, the fluid passes the pressure release valve 99 only when the hydraulic pressure exceeds the specified value. A sample identifying sensor 100 is connected in the pipeline 93 in series for identifying the physical property of the fluid sample passing through the pipeline 93. A check valve 101 is provided for preventing the sample in the sampling chamber from back flowing, a fixed pressure release valve 102 is provided for ensuring pressure releasing when the pressure in the pumping hydraulic pipeline exceeds 28-32 Mpa.

A pump pressure sensor 104 and a pressure release valve 105 are connected to a pipeline 103 which is directed to the sealing and isolating capsules 73 of the dual packer, the pump pressure sensor 104 is provided for monitoring whether the sealing and isolating capsules 73 are pressed normally so as to achieve the normal sealing and isolating, and the pressure release valve 105 is provided for preventing the sealing and isolating capsules from inflating excessively and breaking.

The operation of the dual packer is described as follows: when the center of distance between the sealing and isolating capsules of the dual packer reaches positions of the set formation to be tested, the solenoid valve 86 is powered, thus isolating the passage communicated with the oil tank, the seal valve 94 is closed, and the seal valve 95 is opened. The pumping unit is started up, the fluid sample is pumped from the sealing and isolating annular space, since the sampling electric ignition valve behind the check valve 101 on the pipeline 93 is in a closed state, the fluid flows to the balance piston 89 so as to move the piston 90, thus pressing the hydraulic oil in the chamber 92 into the lower chamber 83 of the isolation valve 79, thus pushing the piston 81 of the isolation valve 79 forwardly, thereby the communication between the isolation pipeline 88 and the well fluid is cut off by the piston rod 82, if the pressure is further applied so as to exceed the designed value of the fixed value pressure release valve 102, the sample is discharged.

The pumping continues by closing the seal valve 95 and opening the seal valve 94, if the pressure exceeds the designed value of the fixed value pressure release valve 99, the fluid flows to the sealing and isolating capsules 73 of the dual packer, thus achieving the "seating and sealing". The pump pressure sensor 104 detects and transmits the pressure value of the sealed and isolated formation to the ground surface continually, if the pressure exceeds the highest specified value of the pressure of the packer, the pressure release valve 105 releases the pressure, if the pressure is below the lowest pressure value required by sealing and isolating, the pumping unit is started up automatically, pressure is further applied to the sealing and isolating capsules 73, after achieving "seating and sealing", the seal valve 94 is closed, and the pumping pre-test and sampling can be performed.

After various tests are performed, the pumping is stopped and the solenoid valve 86 is turned off electrically, the pressure in the lower chamber 83 of the isolation valve 79 is released into the oil tank through the solenoid valve 86, under the pushing of the well fluid, the isolation valve piston 81 and the balance piston 90 return their initial states respectively, the isolation valve piston communicates the pipeline 88 with the well fluid mud, the sealing and isolating capsules 73 of the dual packer are decompressed under the pressing of the well fluid mud, the packer is released, so that the tester can be moved to another testing position and repeat the above operations.

Figure 5:
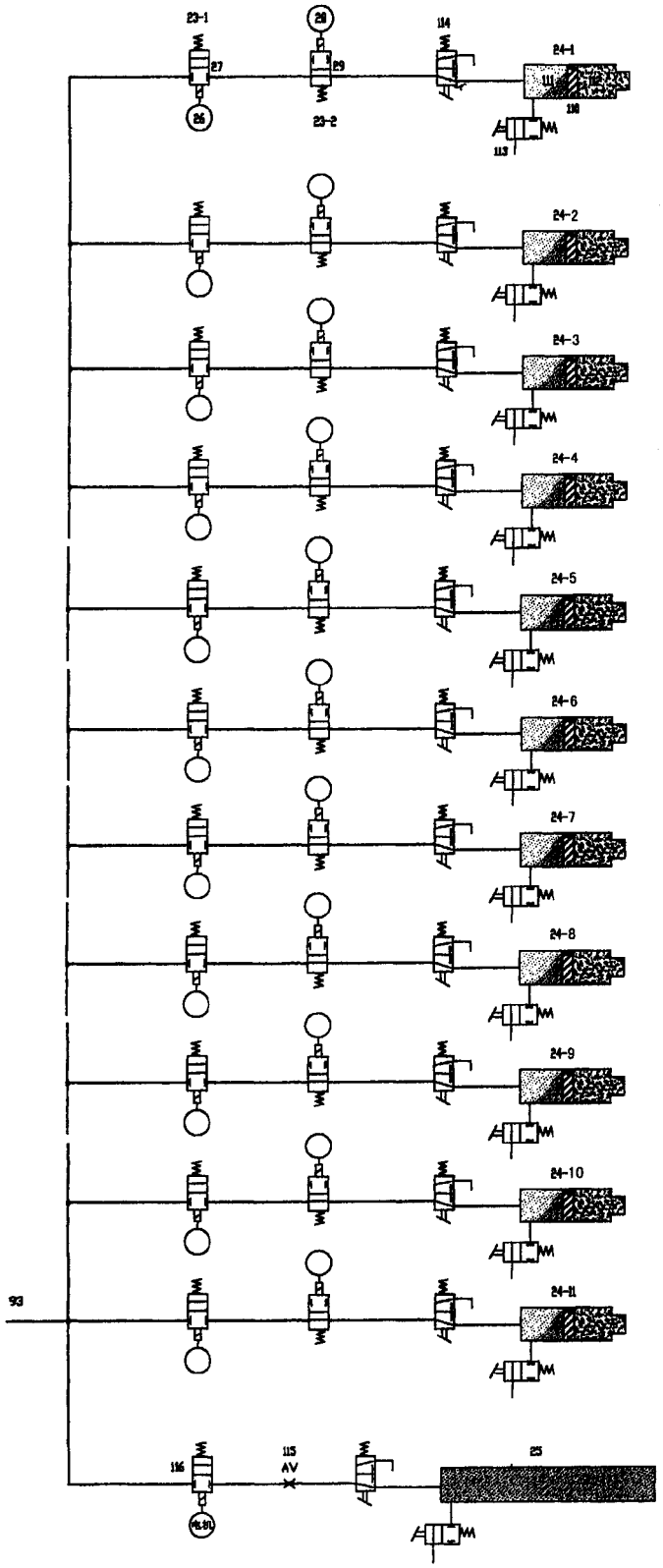
FIG. 5 is a principle diagram of the hydraulic system of the multi sampling unit of the present invention.

FIG. 5 is a principle diagram of the hydraulic system of the multi sampling unit 8. In the sample pipeline 93 through which the packer control section 22 is communicated with the multi sampling unit 8, each sampling chamber is connected with to igniter switch valves 23-1 and 23-2 in series, the first igniter switch valve 23-1 is normally closed and the second igniter switch valve 23-2 is normally opened. Taking the first sampling chamber 24-1 as an example, the first igniter switch valve 23-1 is powered, so that the igniter 26 ignites the blasting powder, the generated high pressure gas makes the switch valve 27 to be unlocked one-off, then the slid valve is pushed by the pumping pressure, the sample pipeline 93 is communicated with the selected sampling chamber 24-1, and the high pressure fluid sample can be pumped into the sampling chamber 24-1. After the sampling chamber is filled, the second igniter switch valve 23-2 is powered, so that the igniter 28 ignites the blasting powder, the generated high pressure gas causes the switch valve 29 to be locked one-off, therefore, the fluid sample in the sampling chamber can be kept in a state in which pressure of the fluid sample is higher than the formation pressure, the sampling chamber, in which the sample will be filled, can be selected freely for each sampling.

There are eleven such sampling chambers 24-1 to 24-11, each sampling chamber has a volume of 450 ml. There is only one artesian flow sampling chamber 25 having a volume of 10L or 20L. The sampling chambers are all high pressure vessels. There is a piston 110 in the sampling chamber 24, the piston 110 partitions the sampling chamber 24 into an upper chamber 111 and a lower chamber 112. The upper chamber 111 is used for sampling, the lower chamber 112 has an opening communicated with the well fluid mud, at the upper end of the sampling chamber, there are provided a sample transport valve 113 and a manually operated two-position and three-way valve 114, they are disposed at the positions as shown before going to the downhole. The two-position and three-way valve 114 is turned to change position before the sampling chamber is detached from the full reservoir sampling and testing apparatus, the sample is sealed in the sampling chamber 111 and the pressure in the pipeline is released. The sample transport valve 113 is used for transporting the sample out of the sampling chamber, at this time, the lower chamber 112 of the sampling chamber can be connected to an external pipeline, the piston 111 is pushed by the pumping pressure, thus transporting the sample out of the sample transport valve 113, alternatively, the piston 110 can be pushed to the top end of the sampling chamber 24 by an external pumping pressure, thus preparing for the next sampling.

A seal valve 116 is connected in the pipeline in front of the artesian flow sampling chamber 25. The artesian flow sampling chamber 25 can accommodate a sample of 10-20L. One function thereof is that the formation fluid sample flows automatically into the sampling chamber during an initial stage of sampling without starting up the pumping, the above sample is mainly the mud filtrate which can not represent the formation original sample, the mud filtrate can be accelerated to be discharged by this method. The other function thereof is that: even if the permeability of the formation is low, the sample of the formation point can be collected. A throttle 115 determines and selects orifice plug combinations having different effects based on the previous well logging data on the ground, thus controlling the speed of the sample flowing into the artesian flow sampling chamber 25 and preventing the sealing and isolating pad of the single detection unit 5 from sealing failure due to an excessive pressure drop and a severe sand production of the formation, and further preventing the sampling from the failure.

The operation of the multi sampling unit is described as follows:

After the full reservoir sampling and testing apparatus reaches a predetermined position in the downhole, succeeds in packing and isolating and accomplishes various tests, if performs sampling, the pumping unit 6 is turned off, the seal valve 116 in front of the artesian flow sampling chamber is opened, the sample flows from single probe unit or dual packer unit into the artesian flow sampling chamber. After starting up the pumping system, the mud filtrate can be discharged through the valve 106 of the dual packer unit. When the sample in the sampling pipeline is determined as qualified sample by the sample identifying sensor 100 provided in the dual packer control section 22, the seal valve 95 is firstly powered to be closed, then the selected igniter switch valve 23-1 in front of the sampling chamber is opened, the piston 110 in the sampling chamber is pushed by pumping pressure, and the sample is pumped into the upper chamber of the sampling chamber, after the sample is filled with the upper chamber another igniter switch valve 23-2 is closed.

The invention claimed is:

1. A full reservoir sampling and testing apparatus comprising:

a ground surface testing and controlling tool including:

a power supply controller, and a computer system storing relevant control, analysis and interpretation software; and a downhole tool including: a wireline bridle coupled to said ground surface testing and controlling tool via a wireline, an adapter joint coupled to said wireline bridle, a gamma ray detector coupled to said adapter joint, for detecting said gamma ray in said formation, an electric unit coupled to said gamma ray detector, a single probe unit coupled to said electric unit, a pumping unit, an upper portion of said pumping unit is coupled to said single probe unit, said pumping unit is adapted to perform pump discharging for discharging formation mud filtrate into high back pressure mud in a well bore, to perform pumping pre-test for performing various-volume pre-tests, and to perform pumping and sampling for closing a discharging passage of said mud filtrate through program control and pumping a sample into a sampling chamber when the sample is identified as a formation original fluid sample in which the level of the mud filtrate in the sample reaches a sensor-determined level during said pump discharging, a dual packer unit coupled to a lower portion of said pumping unit and used to seal and isolate said formation to be tested up and down, a multi sampling unit coupled to said dual packer unit; and a base cone coupled to said multi sampling unit wherein a pump piston of said pumping unit is provided with a suction chamber having a pre-test function, volume of said suction chamber can be changed from zero to a predetermined value repeatedly under action of hydraulic pressure, thus performing pre-test many times, wherein the maximum volume of said suction chamber is 500 ml, thus providing various pre-test flows having a large variation range so as to meet requirements of various formations;

wherein said multi sampling unit comprises a plurality of sampling chambers of high pressure, one artesian flow sampling chamber, and a series of control valves and sample transport valves; a piston is provided in each sampling chamber to partition said sampling chamber into an upper chamber for collecting sample and a lower chamber having an opening communicated with well fluid mud, thus ensuring pressure in said sampling chamber being much higher than formation static pressure while and after sampling is performed.

2. The full reservoir sampling and testing apparatus according to the claim 1, wherein said pumping unit uses a power system having a DC brushless motor and a variable flow pump, or a multi power system having several AC motors and several constant flow pumps, said multi power system employs a plurality of motors to drive a plurality of plunger pumps respectively so as to provide various pre-test flows, so that dynamic parameters and original formation oil, gas and water outputs of the full reservoir of one well can be determined through tests performed by going to the downhole one time, thus creating a database of said dynamic parameters of the full reservoir in one well.

3. The full reservoir sampling and testing apparatus according to the claim 1, wherein said pumping unit comprises a hydraulic oil tank, a multistage power section, an upper pumping fluid control section, a pumping fluid tank and a lower pumping fluid control section, said pump discharging can be preformed by using a selected maximum discharge capacity under a pressure higher than a formation fluid saturation pressure.

4. The full reservoir sampling and testing apparatus according to the claim 3, wherein said pumping unit uses a power system having a DC brushless motor and a variable flow pump, or a multi power system having several AC motors and several constant flow pumps, said multi power system employs a plurality of motors to drive a plurality of plunger pumps respectively, said pumps can provides various discharging capacity having a large variation range so as to meet requirements of various formations.

5. The full reservoir sampling and testing apparatus according to the claim 1, wherein said pumping unit uses a power system having a DC brushless motor and a variable flow pump, or a multi power system having several AC motors and several constant flow pumps, said multi power system employs a plurality of motors to drive a plurality of plunger pumps respectively, said pumps can provides various discharging capacity having a large variation range so as to meet requirements of various formations.

6. The full reservoir sampling and testing apparatus according to the claim 1, wherein said multi sampling unit comprises a plurality of sampling chambers and two igniter switch valves are connected to each one of the plurality of sampling chambers in series, one of which is normally closed and the other is normally opened; closing and opening of each sampling chamber are controlled by the igniter switch valves, each igniter switch valve is composed of an electric igniter and an slide-valve switch.

7. The full reservoir sampling and testing apparatus according to the claim 1, wherein said dual packer control section is a control assembly used for controlling "seating and sealing" and unsealing of sealing and isolating capsules of the dual packer, a hydraulic oil tank is provided at the dual packer control section, and a balance piston is provided in the hydraulic oil tank to partition the hydraulic oil tank into two portions, an outside of the piston is communicated with the well fluid mud, and an inside thereof is filled with a hydraulic oil, the balance piston can move in the hydraulic oil tank, thus keeping the oil pressure in the hydraulic oil tank equal to a well fluid pressure all the time; said dual packer control section is also provided with an isolation valve, a seal valve, a check valve, a solenoid valve, a pump pressure sensor, a pressure release valve, so as to accomplish "seating and sealing" and unsealing of the dual packer, a sample identifying sensor is connected in a sample pipeline of the dual packer control section in series for identifying physical properties of a fluid sample passing through the sample pipeline so as to obtain the formation original fluid wherein the mud filtrate in the formation fluid reaches the sensor-determined level of the reservoir.

8. The full reservoir sampling and testing apparatus according to the claim 7, wherein said sampling unit has more than ten sampling chambers for directly obtaining the formation original fluid samples wherein the mud filtrate in the formation fluid reaches the sensor-determined level in large batches, a full-parameters database of original fluid physical properties of full reservoir in one well can be created by analyzing the original fluid samples under conditions of high temperature-high pressure and atmospheric pressure in a laboratory.

9. The full reservoir sampling and testing apparatus according to the claim 1, wherein said sampling unit has more than ten sampling chambers for directly obtaining the formation original fluid samples wherein the mud filtrate in the formation fluid reaches the sensor-determined level in large batches, a full-parameters database of original fluid physical property of full reservoir in one well can be created by analyzing the original fluid samples under conditions of high temperature-high pressure and atmospheric pressure in a laboratory.

* * * * *